US005263280A

United States Patent [19]

Dilcher

[11] Patent Number: 5,263,280

[45] Date of Patent: Nov. 23, 1993

[54] DEVICE FOR MOVING A SWINGING AND SLIDING DOOR IN A MASS-TRANSIT CAR ESPECIALLY A CAR THAT TRAVELS ALONG A TRACK

[75] Inventor: Dietmar Dilcher, Vellmar, Fed. Rep. of Germany

[73] Assignee: Firma Gebr. Bode & Co. GmbH, Kassel 1, Fed. Rep. of Germany

[21] Appl. No.: 955,090

[22] Filed: Oct. 1, 1992

[30] Foreign Application Priority Data

Oct. 7, 1991 [DE] Fed. Rep. of Germany ..... 4133179

[51] Int. Cl.[5] ..... E05D 15/10

[52] U.S. Cl. ..... 49/212; 49/218

[58] Field of Search ..... 49/210, 212, 213, 215, 49/218, 209, 220, 216

[56] References Cited

U.S. PATENT DOCUMENTS

| | | | |
|---|---|---|---|
| 4,028,850 | 6/1977 | Marzocco | 49/212 |
| 4,503,638 | 3/1985 | Schindehutte | 49/218 X |
| 4,924,625 | 5/1990 | Dilcher | 49/212 |
| 5,140,770 | 8/1992 | Morvan | 49/218 X |
| 5,142,823 | 9/1992 | Brandenburg et al. | 49/218 X |

FOREIGN PATENT DOCUMENTS 0320591 10/1988 European Pat. Off. .

*Primary Examiner*—Philip C. Kannan

*Attorney, Agent, or Firm*—Sprung Horn Kramer & Woods

[57] ABSTRACT

A device for moving a swinging and sliding door in a mass-transit car, especially a car that travels along a track. Each panel of the door slides lengthwise along a guide element. The guide element moves as part of a four-point articulation across the plane of the panel. The lengthwise motion of the leaf is coordinated with its transverse motion by a rail. The rail is fastened to the doorframe. Guide means are fastened to the panel and engage the rail. A drive mechanism on the panel directs force toward the guide element. As the drive mechanism (20–22, 30 & 31, or 40 & 4n1) reacts it exerts torque on an expansion element (25, 35, or 45) between the guide element (3) and a supporting component (25.2, 35.2, or 45.2) attached to the doorframe (16). The torque produces a force substantially normal to the guide element. The force generates the transverse motion.

10 Claims, 8 Drawing Sheets

Fig. 10a
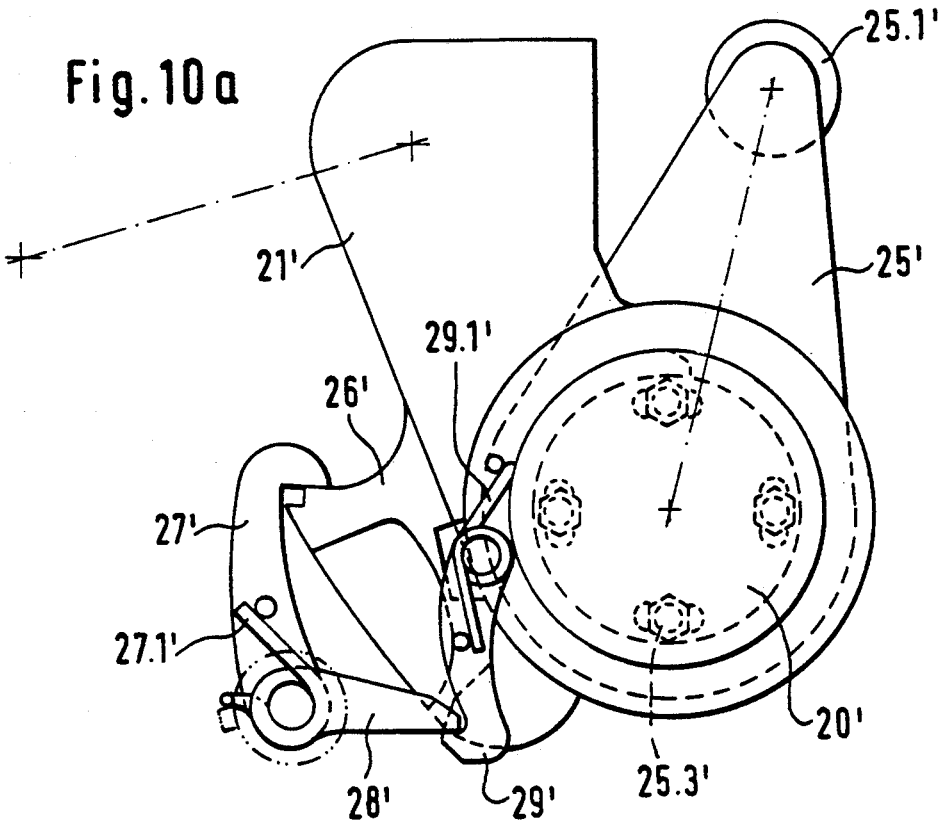
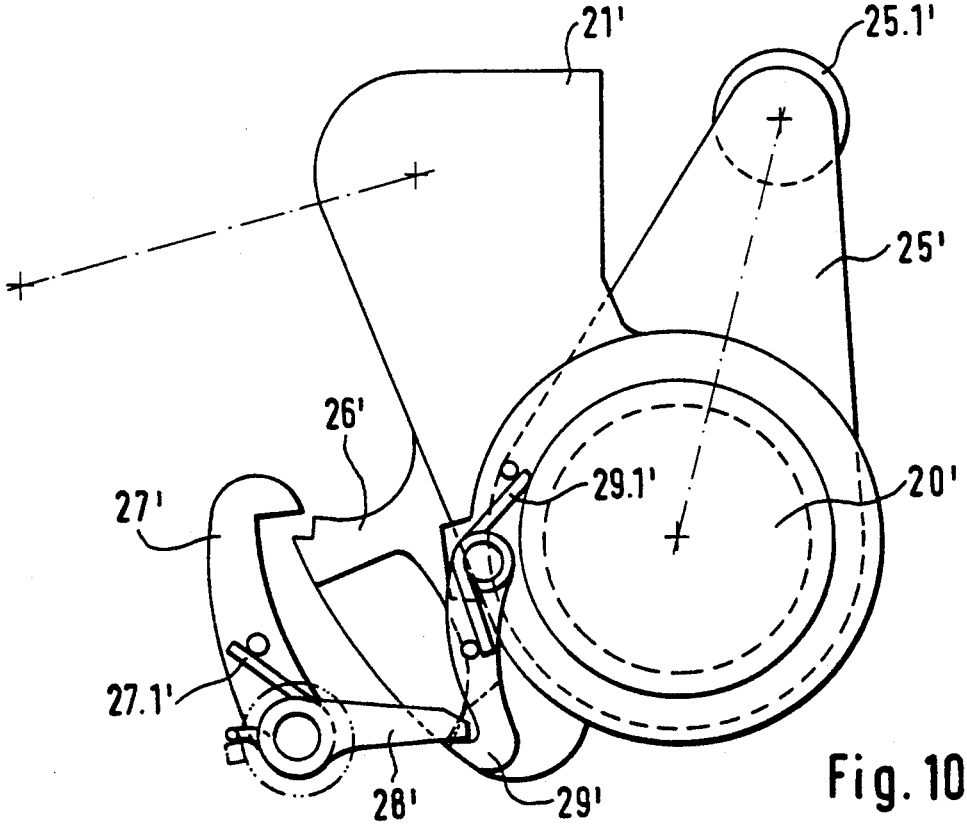
Fig. 10b

Fig.10c
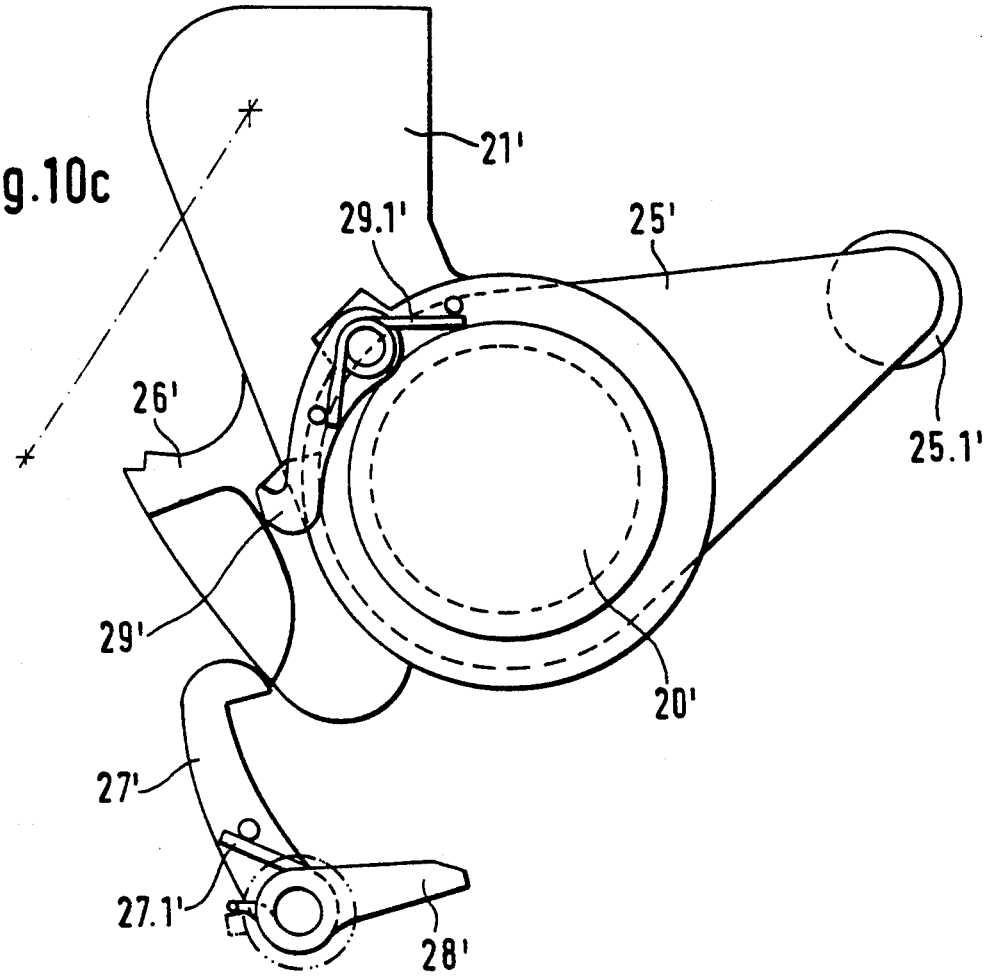
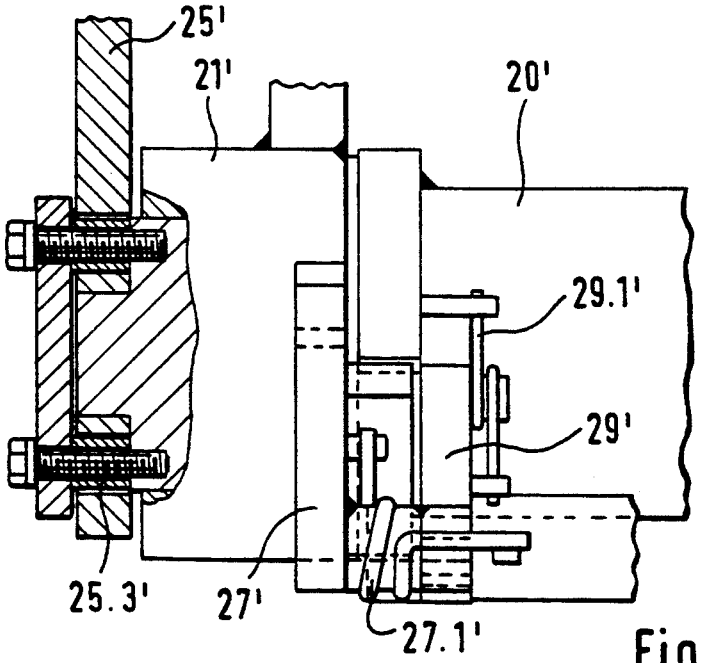
Fig. 10d

DEVICE FOR MOVING A SWINGING AND SLIDING DOOR IN A MASS-TRANSIT CAR ESPECIALLY A CAR THAT TRAVELS ALONG A TRACK

BACKGROUND OF THE INVENTION

The invention relates to a device for moving a swinging and sliding door in a mass-transit car, especially a car that travels along a track. Each panel of the door slides lengthwise along a guide element. The guide element moves as part of a four-point articulation across the plane of the panel. The lengthwise motion of the leaf is coordinated with its transverse motion by a guide rail. The rail is fastened to the doorframe. Guide means are fastened to the panel and engage the rail. A drive mechanism on the panel directs force toward the guide element.

A device of this type is described for example in EP 0 320 591 A2.

Known swinging and sliding doors have an overall drawback. At least the last stage of the panel's transverse motion must be assumed as the door closes by the locking mechanisms. The locking mechanisms can be rotating bolts that draw the panel into the locked position. Another drive mechanism is accordingly needed to generate at least some of the forces responsible for the transverse motion. This makes the drive mechanisms expensive.

SUMMARY OF THE INVENTION

The object of the present invention is to improve a device with the characteristics described above to the extent that the panel can be moved all the way into its closure position by forces derived from a single drive mechanism.

This object is attained in accordance with the present invention in that as the drive mechanism reacts it exerts torque on an expansion element. The expansion element is positioned between the guide element and a supporting component attached to the doorframe. The torque produces a force substantially normal to the guide element. The force generates the transverse motion.

Advantageous embodiments of the invention are recited in the subsidiary claims.

The basic theory of the invention is to position one drive mechanism where its function can be divided, with its take-off component responsible for moving the panel along the guide element and its force of reaction responsible for moving the guide element transversely. It is of particular advantage for the drive mechanism to be mounted directly on the guide element and rest on the doorframe by way of the expansion element such that the reaction will move both the drive mechanism and the guide element transversely.

An expansion element of the type employed in accordance with the invention is a mechanism positioned between two points of contact and wherein a force or torque can be induced such that forces will be constantly generated on the points of contact in opposite directions. Such an expansion element can for example be a pivoting lever with one point of contact at its pivot and the other at its free end. The expansion element could, however, also be an angled lever.

To allow initiation of the lengthwise motion as soon as possible while the door is opening, it is also advantageous for the guide element to be a known coupling in the form of one link in a four-point articulation with two mutually opposed cranks.

The drive mechanism can for example be a motor and chain or belt, a motor with a threaded shaft, or even a piston-and-cylinder mechanism, especially one with no piston rod.

It has been demonstrated to be of particular advantage for the device in accordance with the invention to have an additional mechanism to guide the motion of the panel. This supplemental guide mechanism will include what is called a tubular mast, which is an essentially vertical shaft that rotates on the doorframe. Mounted on the mast are two roller levers. One lever engages the rail at the top of the leaf and the other the rail at the bottom. The mast can be attached to one of the cranks in the four-point articulation by way of a tie rod. It could also be attached to the guide element by way of the upper roller lever. In the later event the shaft's rotation will be directly derived from the articulation's transverse motion. The result is stable channeling of the panel at the bottom and optionally at the top.

It has been demonstrated of particular advantage for the locking element in the locking mechanism to be mounted on a pivoting component, the motion of which is coupled with the transverse motion of the four-point articulation. The pivoting component could for example be one of the cranks in the four-point articulation. In this event the drive mechanism's force of reaction can be even further exploited to control a mechanism that disengages the mechanism that locks the panel into its closure position.

As will be specified hereinafter with reference to specific embodiments, the device for moving swinging and sliding doors in accordance with the present invention makes it possible to concentrate the driving means. This is because a single drive mechanism is responsible for both the lengthwise motion and the transverse motion of the panel as the door closes and arrives in and leaves its locked position. Furthermore, the same drive mechanism can optionally control the disengagement procedures that occur as the door begins to open. It is also possible in a very simple way to guide the panel securely and reliably.

Embodiments of the swinging and sliding door will now be specified with reference to the drawings.

BRIEF DESCRIPTION OF THE DRAWINGS

FIGS. 10*a*, 10*b*, and 10*c* are top views of a locking mechanism in three different positions.

FIG. 10*d* is a side view of the locking mechanism illustrated in FIG. 10*a*.

DETAILED DESCRIPTION OF THE INVENTION

Figure 1:
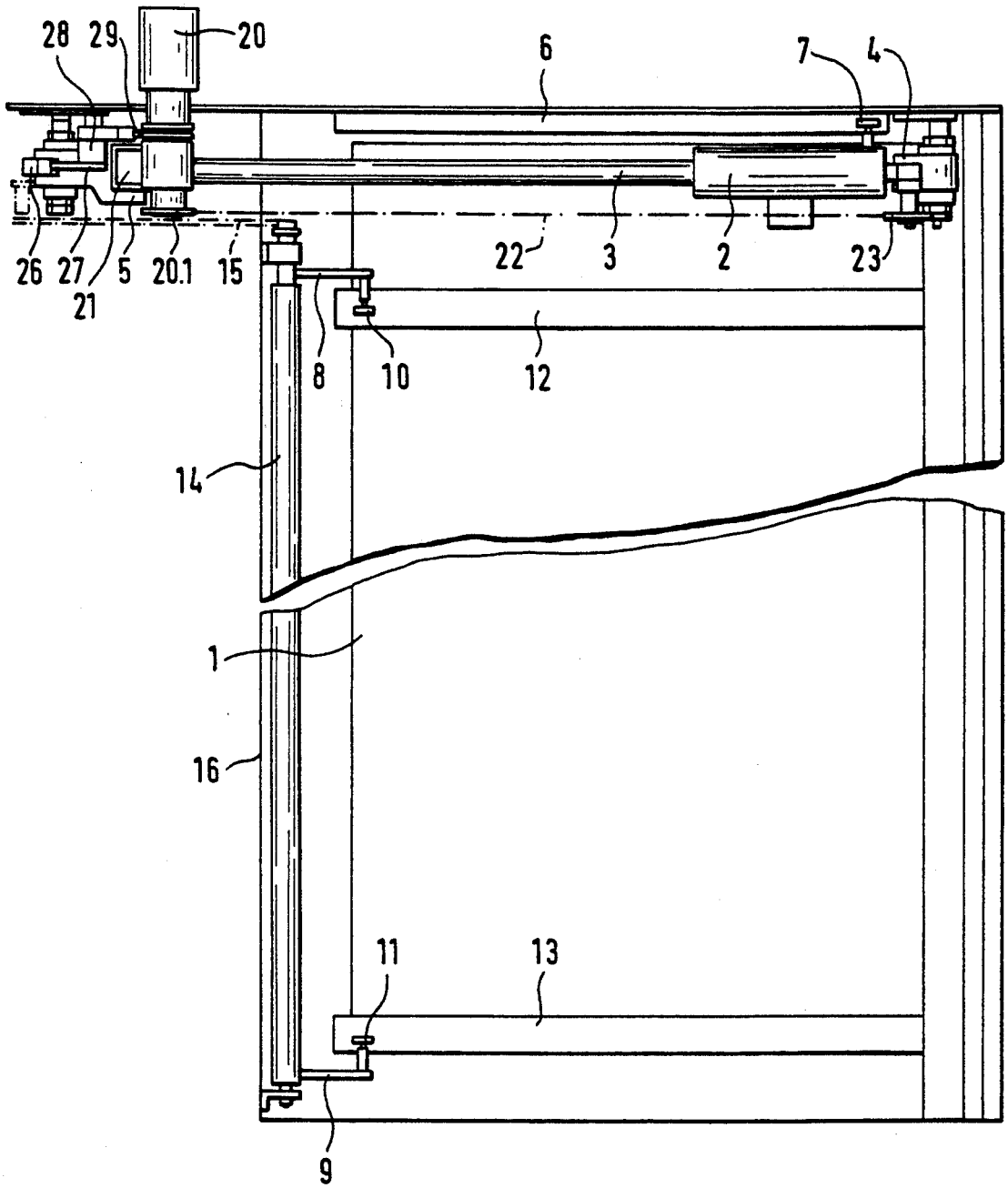
FIG. 1 is a view of a swinging and sliding door from inside the car with a single drive mechanism and with a supplemental mechanism for guiding the panel.
Figure 2:
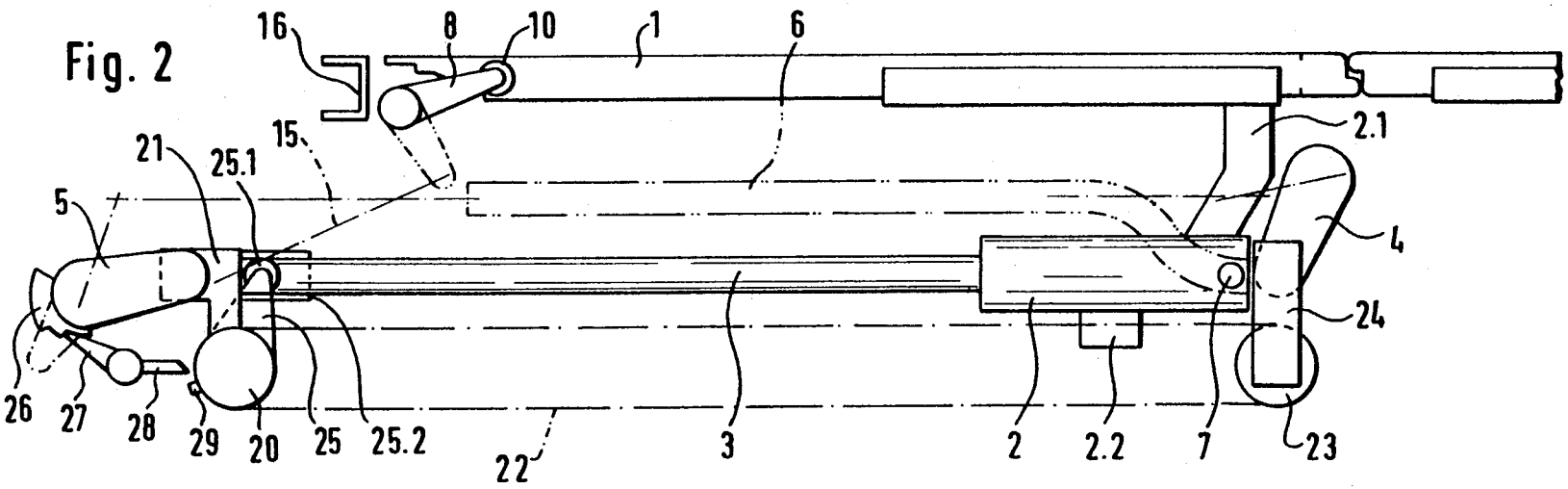
FIG. 2 is a top view of the door illustrated in FIG. 1, when closed.

Referring now to FIGS. 1 and 2, the panel 1 of the swinging and sliding door illustrated in the drawing is attached to a supporting component in the form of a ball bushing 2 by a torque-resistant supporting arm 2.1. Bushing 2 travels along a supporting rail in the form of a round rod 3 that constitutes a guide element. The guide element and the supporting component that travels along it can be of any shape known in swinging and sliding doors. Rod 3 has crank 4 and 5 at each end. Cranks 4 and 5 rotate on a doorframe 16, which is only suggested in the drawing. Rod 3 acts as a coupling between cranks 4 and 5, in conjunction with which it constitutes a four-point articulation. Crank 4 rotates right and crank 5 left as the door opens. Cranks 4 and 5, rod 3, and doorframe 16 accordingly comprise a four-point articulation with cranks that move in opposite directions like the one described for example in EP 0 320 591 A2.

The lengthwise motion of panel 1 is coordinated with its transverse motion by a guide rail 6. A guide roller 7 rolls back and forth in guide rail 6 and is attached to supporting arm 2.1.

Panel 1 is precisely guided by a supplemental guide mechanism. This mechanism includes an upper roller lever 8 and a lower roller lever 9. Upper roller lever 8 engages by way of a guide roller 10 a horizontal guide rail 12 at the top of panel 1. Lower roller lever 9 engages by way of a guide roller 11 a horizontal guide rail 13 at the bottom of the panel. A tubular mast 14 extends from roller lever 8 to lower roller lever 9. Mast 14 rotates on doorframe 16. The mast 14 in the illustrated embodiment is vertical. Such a mast, however, could also slope slightly, in conjunction with curved panels for example. In that event guide rails 12 and 13 would be displaced across the panel.

The top of mast 14 is, as is only suggested in FIGS. 1 and 2, attached to the four-point articulation crank 5 by a tie rod 15.

Figure 6:
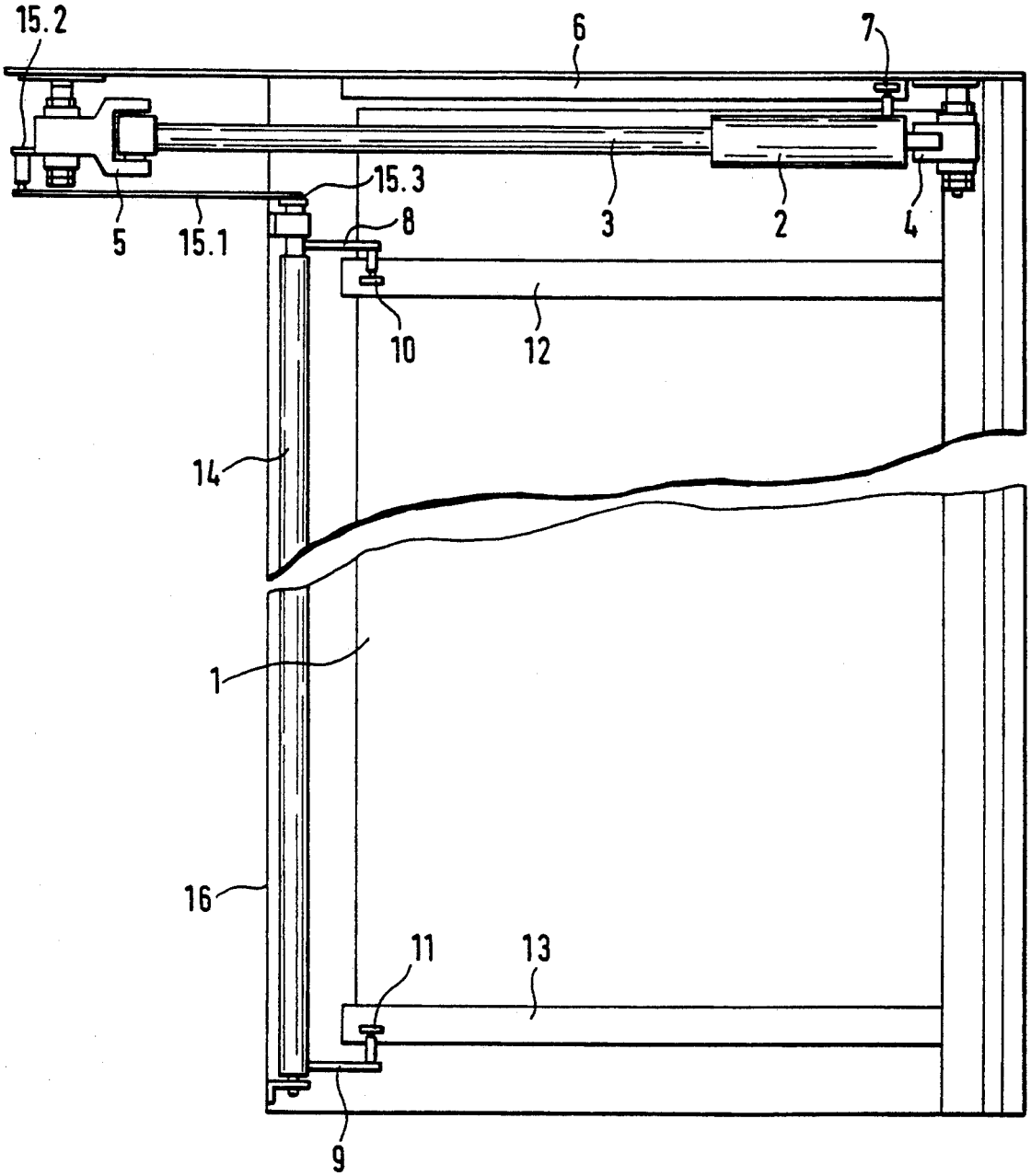
FIG. 6 is a view similar to that in FIG. 1 of the swinging and sliding door with one type of panel-guidance system but without a drive mechanism.
Figure 7:
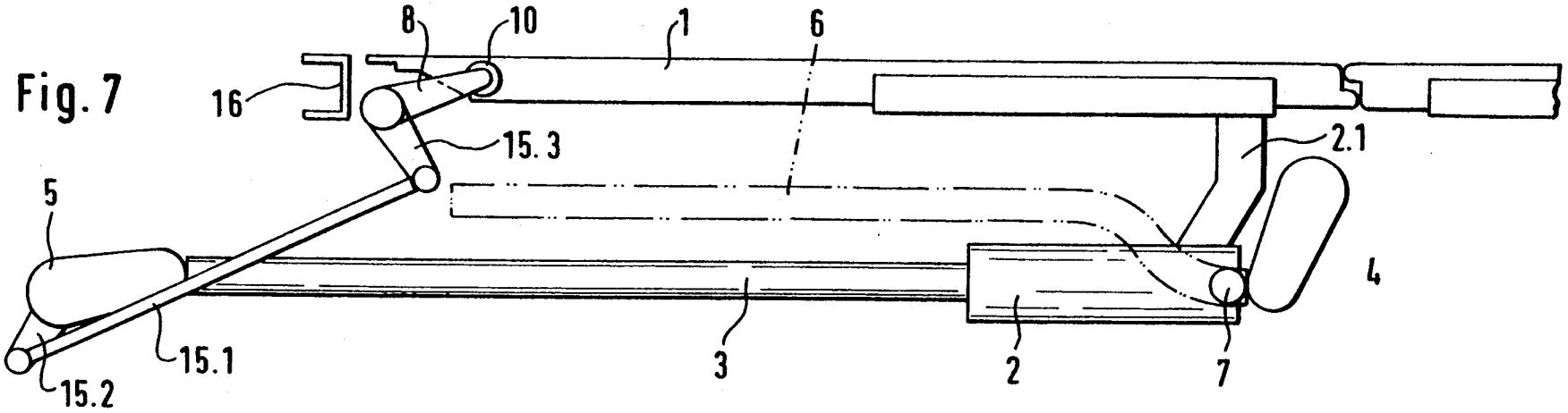
FIG. 7 is a view similar to that in FIG. 2 of the swinging and sliding door illustrated in FIG. 6.

As will be evident from the more specific representation in FIGS. 6 and 7, crank 5 has a pivoting lever 15.2 that is attached to another pivoting lever 15.3 at the top of mast 14 by a coupling rod 15.1.

Tie rod 15 transmits the motion of crank 5 and hence the transverse motion of the four-point articulation directly to mast 14, initiating torque in it. Roller levers 8 and 9 will accordingly pivot out and support and guide the transverse and lengthwise motion of panel 1.

For simplicity's sake neither the drive mechanism nor the locking mechanism are illustrated in FIGS. 6 and 7 or 8 and 9. These components will be specified hereinafter with reference to FIGS. 1 through 5 and 10*a* through 10*d*.

For the present, however, a slightly different version of the panel-guidance system will be described with reference to FIGS. 8 and 9. The parts illustrated in FIGS. 8 and 9 that are the same as those illustrated in FIGS. 6 and 7 are labeled with the same numbers. Panel 1 is again suspended by way of bushing 2 on rod 3, which again constitutes in conjunction with cranks 4 and 5 a four-point articulation with cranks that travel in opposite directions. The lengthwise motion is again coordinated with the transverse motion by way of guide rail 6 and guide roller 7.

The supplemental guide mechanism again has an upper roller lever 8′ and a lower roller lever 9′. Upper roller lever 8′ also engages by way of a guide roller 10′ a guide rail 12′ at the top. Lower roller lever 9′ also engages by way of a guide roller 11′ a guide rail 13′ at the bottom of the panel. Upper roller lever 8′, however, is not coupled to the four-point articulation in this embodiment by way of coupling rod. Instead, a supporting structure 17 extends as will be evident from FIG. 9 below rod 3 and follows its transverse motion.

At the end facing panel 1 supporting structure 17 has a supporting arm 17.1. Fastened to the end of supporting arm 17.1 is a short supplemental guide rail 19. A supplemental guide roller 18 on upper roller lever 8′ engages supplemental guide rail 19. Additional guide rail 19 extends in the immediate equipment of guide rail 12′. The forces exerted on additional guide rail 19 by rod 3 are transmitted directly to upper roller lever 8′ through additional guide roller 18. The pivoting motion of lever 8′ introduces torque in mast 14′.

Figure 9:
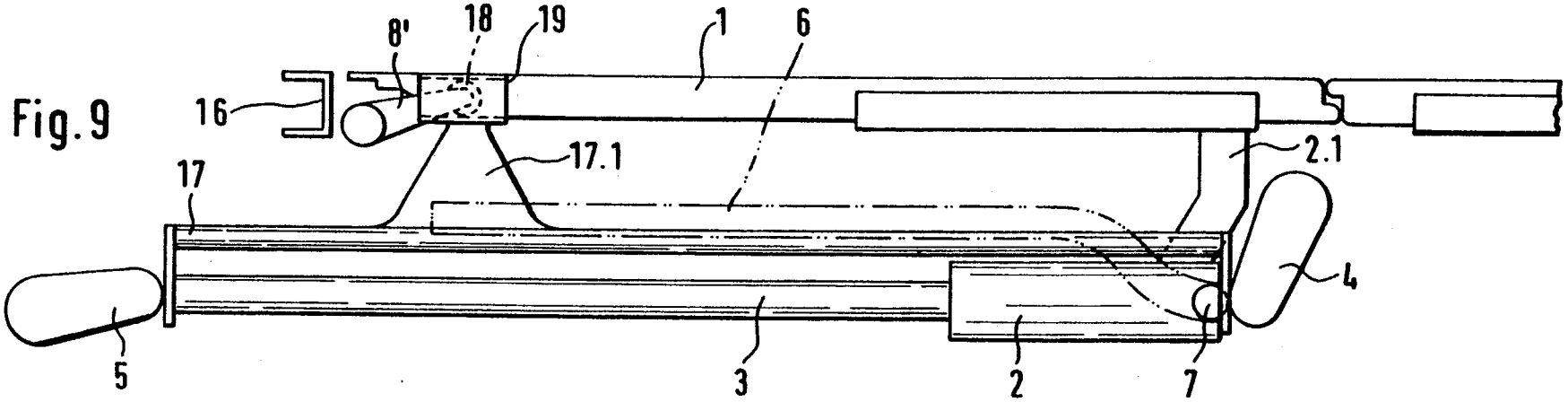
FIG. 9 is a view similar to that in FIG. 2 of the swinging and sliding door illustrated in FIG. 8.
Figure 8:
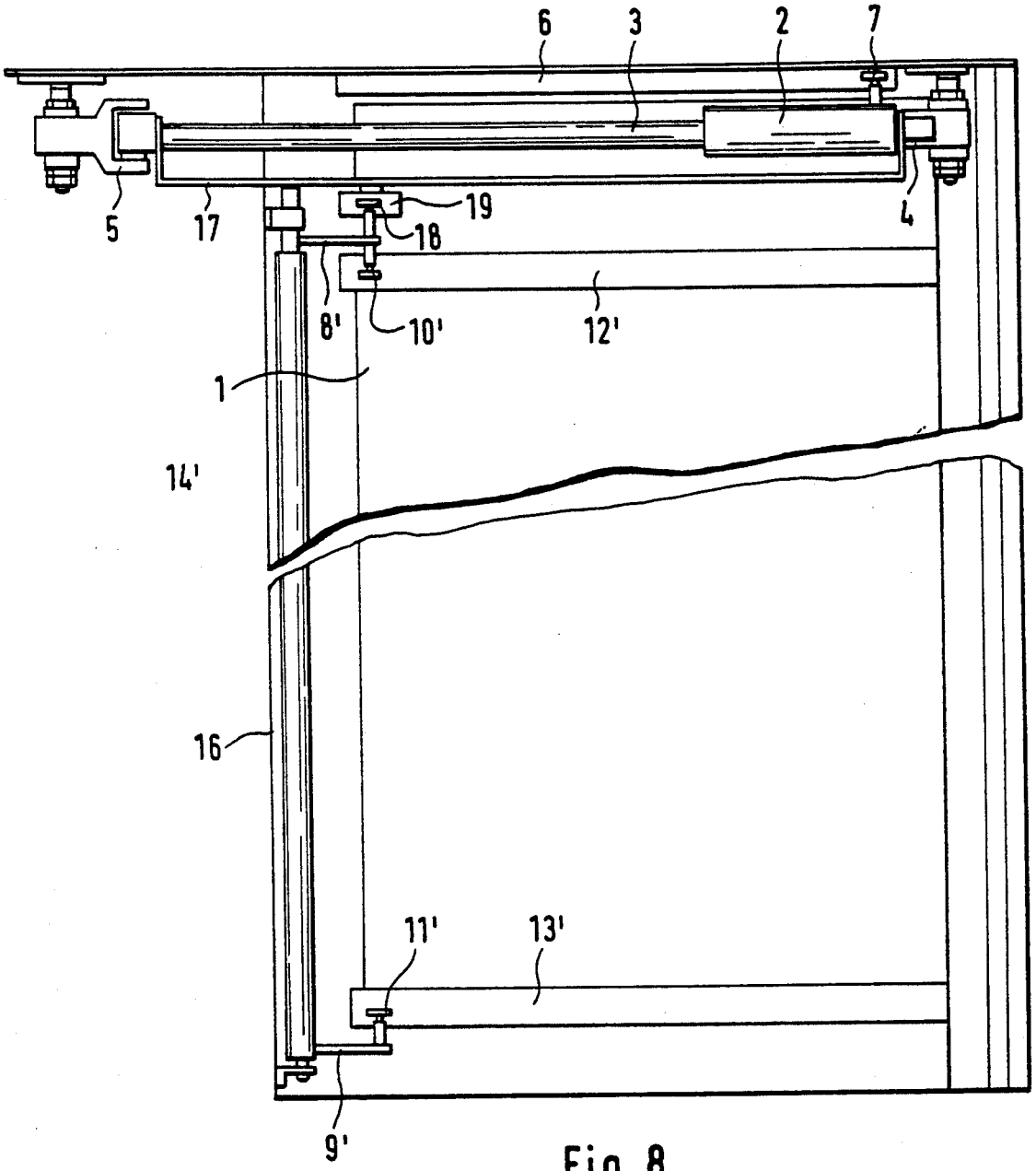
FIG. 8 is a view similar to that in FIG. 1 of the swinging and sliding door without the drive mechanism and with a different panel-guidance system.

The embodiment illustrated in FIGS. 8 and 9 in particular results in guidance that is stable and precise over the whole path followed by the opening and closing door.

Figure 5:
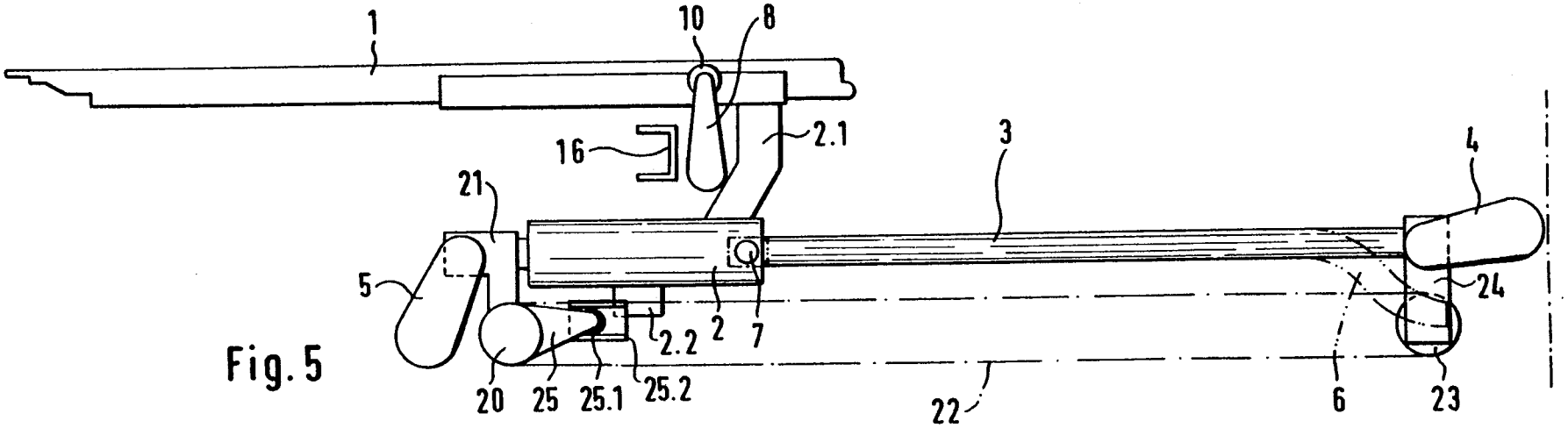
FIG. 5 is a view similar to that in FIG. 2 of another version of the swinging and sliding door illustrated in FIG. 1, when open.

One way to drive the swinging door will now be specified along with a locking mechanism with reference to FIGS. 1, 2, and 5.

The mechanism that drives the motion of panel 1 includes a motor 20 and a downstream transmission. The motor housing rotates on a base 21. Base 21 is fastened to rod 3 in the vicinity of its attachment to crank 5. The takeoff shaft of motor 20 is provided with a cogwheel 20.1 that drives a chain or belt 22. Chain or belt 22 travels around a deflection wheel 23. Deflection wheel 23 rotates on a base 24. Ball bushing 2 is attached by a connector 2.2 to chain or belt 22. Also attached to the motor housing is an expansion lever 25 that travels on a guide roller 25.1 in a slotted guide 25.2 that is secured in an unillustrated way to doorframe 16. As the motor comes into operation to open the door, the housing's reaction will generate a rotation that will, due to expansion lever 25 lead to an outward rotation of the end of rod 3 attached to crank 5. The transverse motion of rod 3 and hence of panel 1 will accordingly be introduced at this point. Similarly, when motor 20 comes into operation to close the door, the transverse motion of rod 3 will act inward.

FIGS. 1 and 2 illustrate another embodiment of a mechanism for locking panel 1 closed. This mechanism has been left out of the version illustrated in FIG. 5. Locking element 26 is coupled with the crank pin 5 on the left in FIGS. 1 and 2 and rotates around its point of rotation. It has in a known way two drop-in positions, one a preliminary and one a main position. A pivoting bar 27 that is coupled with a control arm 28 engages locking element 26. There is a control cam 29 on the housing of motor 20. Due to the force of the motor housing's reaction, cam 29 will, as the housing rotates, move as will be evident from FIG. 2 against control arm 28 and will accordingly trigger the disengaging motion of pivoting bar 27. To ensure that the disengagement occurs before the transverse motion of rod 3 in response to the reaction, the housing is attached to guide arm 25 by an unillustrated element that allows a prescribed rotary or longitudinal play, by way of guide pins in slots for example that are adjusted to ensure that the disengagement occurs before the transverse motion of the panel can be supported.

Figure 3:
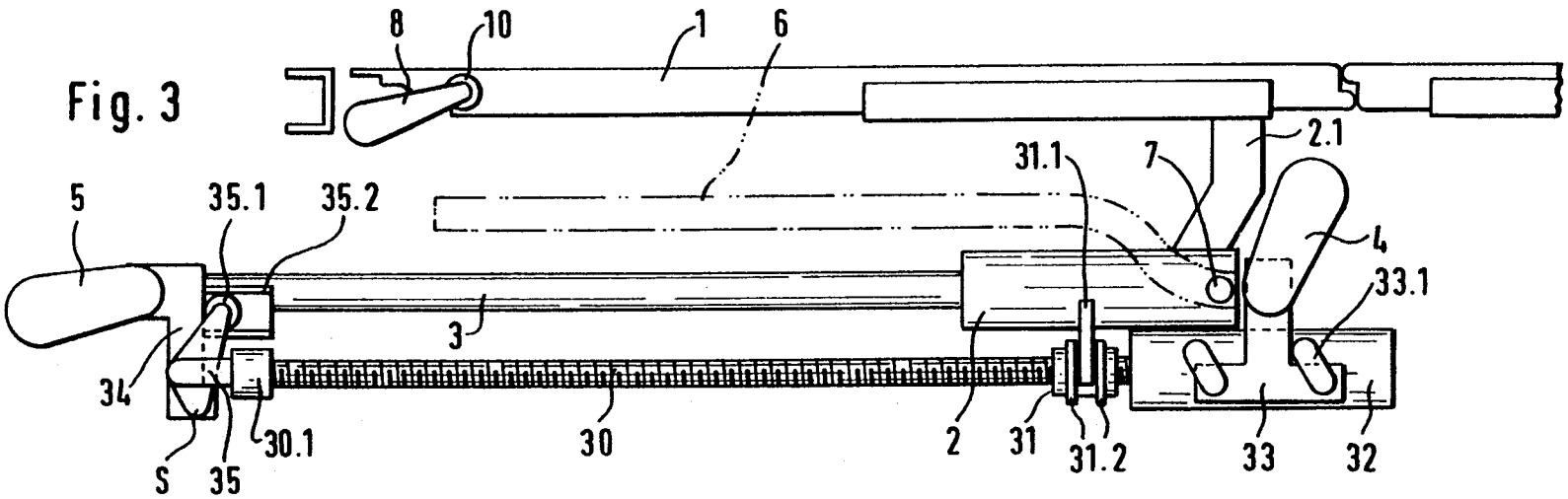
FIG. 3 is a view similar to that in FIG. 2 of a swinging and sliding door with another type of drive mechanism.
Figure 4:
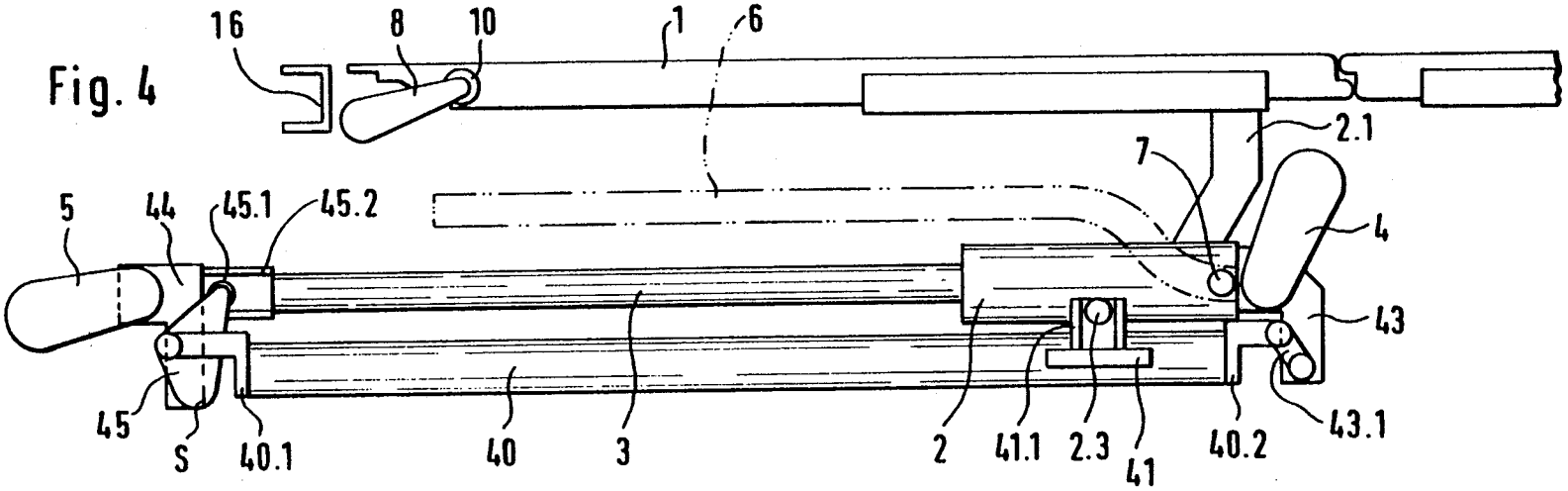
FIG. 4 is a view similar to that in FIG. 2 of a swinging and sliding door with still another type of drive mechanism.

FIGS. 3 and 4 illustrate devices for moving swinging and sliding doors with different types of drive mechanism.

Of the supplemental door-panel guide mechanism only upper roller lever 8 and guide roller 10 are illustrated in FIGS. 3 and 4. Panel 1 rests on bushing 2 on rod 3. Rod 3 is again with cranks 4 and 5 part of the aforesaid four-point articulation. The mechanisms that couple upper roller lever 8 to the four-point articulation are not illustrated and can be similar to those specified with reference to FIGS. 6 and 7 or 8 and 9.

The motion of the panel in the embodiment illustrated in FIG. 3 is initiated by a drive mechanism that includes a motor 32 with a threaded spindle 30.

Motor 32 is suspended by straps 33.1 and rotates on a base 33 that is fastened to rod 3 in the vicinity of crank 4. The end of spindle 30 is attached by a bearing member 30.1 to an expansion lever 35 that rotates around a point S on a base 34. Base 34 is fastened to rod 3 in the vicinity of crank 5. Expansion lever 35 rests on its free end in an unillustrated way against doorframe 16 by way of a guide roller 35.1 and a slotted guide 35.2. Traveling on the spindle is a nut 31 that connects to bushing 2 by way of a follower 31.1 secured in a slotted guide 31, allowing for small transverse motions between the bushing and the nut as dictated by the motor's suspension.

As motor 32 comes into operation the following motion of nut 31 generates a reaction that produces a longitudinal displacement of spindle 30 and accordingly subjects expansion lever 35 to a torque that, due to the support of expansion lever 35, leads to a transverse motion on the part of the end of rod 3 attached to crank 5.

The motion of the panel 1 illustrated in FIG. 4 is generated by a drive mechanism that includes a pneumatic cylinder 40 and a piston 41 that travels into and out of it. Piston 41 has no rod and is fastened to bushing 2 such that it carries the bushing along with it longitudinally while allowing small transverse displacements between piston 41 and bushing 2. The articulation between piston 41 and bushing 2 has for this purpose a slotted guide 41.1 for the guide pin 2.3 on bushing 2 to travel in.

Cylinder 40 is attached at one end to an expansion lever 45 by way of a holder 40.1. Lever 45 rotates around a point S on a base 44. Base 44 is attached to rod 3 in the vicinity of crank 5. At its other end cylinder 40 is articulated by a holder 40.2 and a strap 43.1 to another base 43. Base 43 is also secured to rod 3 in the vicinity of crank 4. As piston 41 commences to initiate the lengthwise motion of bushing 2, the reaction will induce a longitudinal displacement of cylinder 40. This displacement will be transmitted to expansion lever 45 and, due to its contact with the free end, will initiate by way of guide roller 45.1 and slotted guide 45.2 on doorframe 16 the transverse motion of the end of rod 3 that is attached to crank 5.

The drive mechanisms in every illustrated embodiment move transversely along with rod 3, the guide element, that is. Embodiments are of course also conceivable wherein the drive mechanisms are rigidly fastened to the doorframe, and the motions are transversely transmitted to the guide element, rod 3, that is, by way of an appropriate designed expanding element through the forces of reaction.

A somewhat different embodiment of a locking mechanism will now be specified with reference to FIGS. 10*a* through 10*d*. This embodiment can be employed instead of the one specified with reference to FIGS. 1 and 2. This locking mechanism operates in conjunction with a drive mechanism. The drive mechanism, like the one illustrated in FIGS. 1 and 2, has a motor and a downstream transmission that drives a chain or belt. FIGS. 10*a* through 10*c* are enlarged details of a section through the vicinity of the motor illustrated in FIG. 2.

Motor housing 20' rotates on base 21' and is attached to an expansion lever 25'. On the free end of lever 25' is a guide roller 25.1' that rests as previously specified but unillustrated in a slotted guide on the doorframe. Housing 20' is attached to expansion lever 25' by screws 25.3' and slots. Due to the moment of reaction that occurs when the housing rotates accordingly, the expansion lever will not be able to pivot until a prescribed rotation has been traveled through. Mounted on base 21' is a locking element 26'. Element 26' is engaged by a pivoting bar 27' that drops into it subject to a spring 27.1'. Pivoting bar 27' is coupled to a control arm 28'. A hook 29' pivots on the housing of motor 20' subject to a spring 29.1'. FIG. 10*a* represents the locking mechanism locked. Due to the moment of reaction on the housing of motor 20, hook 29' will move as the housing rotates, entraining control arm 28'. Pivoting bar 27' swings out of the way and releases control arm 28'. This state is illustrated FIG. 10*b*. Once the prescribed rotation has been executed, housing 20' will entrain expansion lever 25' as illustrated in FIG. 10*d*, and the guide element's transverse motion will be initiated as hereintofore described. This state is represented in FIG. 10*c*. The motion will be in the opposite direction when the door closes, and pivoting bar 27' will eventually drop back into locking element 26' as illustrated in FIG. 10*a*.

A clutch can be interposed between the motor and its downstream mechanisms in any of the drive mechanisms specified herein to limit the force or moment and prevent the door from slamming. It may also be practical to interpose a magnetic clutch between the motor and its downstream mechanisms so that they can be disengaged in an emergency.

What is claimed is:

1. A device for moving a swinging and sliding door in a mass-transit car, especially a car that travels along a track, comprising: a swinging and sliding door having at least one panel; means forming a four point articulation across a plane of the at least one panel including the doorframe and a guide element which is movable transversely with respect to the doorframe; guide means fastened to the at least one panel and engaging the guide element for the sliding movement of the at least one panel along the guide element; and drive means for directing a force toward the guide element comprising a supporting component attached to the doorframe, an expansion element between the guide element and the supporting component and means for exerting torque on the expansion element to produce a force substantially normal to the guide element to effect the transverse motion of the guide element relative to the doorframe.

2. The device as in claim 1, further comprising means mounting the drive means and the expansion element on the guide element comprising a rail fastened to the doorframe and a guide roller on the rail on which the expansion element rests.

3. A device as in claim 2, wherein the drive means comprises a drive parallel to the guide element and coupled to the at least one door panel, a motor and a downstream transmission with a housing rotating around a vertical axis on the guide element and having a takeoff shaft driving the drive, and wherein the expansion element comprises an expansion lever fastened to the housing and resting on the guide roller on the rail fastened to the doorframe.

4. The device as in claim 2, wherein the drive means comprises a pneumatic cylinder paralleling and mounted on the guide element, a piston attached to the at least one door panel and articulated to the expansion element comprising an expansion lever pivoting on the guide element and resting on the guide roller on the rail fastened to the doorframe.

5. The device as in claim 2, wherein the drive means comprises a motor with a nut connected to the at least one door panel, a threaded spindle paralleling and sliding back and forth on the guide element and driven by the motor, wherein the expansion element comprises an expansion lever mounted on the guide element and articulated to one end of the spindle and resting on the guide roller on the rail fastened to the doorframe.

6. The device as in claim 1, wherein the four-point articulation comprises a crank and further comprising a mast that rotates on the doorframe and has two roller levers mounted thereon, guide rails on the at least one door panel engaged by the levers and a rod coupling the mast to the crank of the four-point articulation.

7. The device as in claim 1, further comprising a mast that rotates on the doorframe, upper and lower roller levers mounted on the mast, guide rails on the at least one door panel and engaged by the roller levers, a supplemental roller that is coaxial with the upper roller lever mounted on one guide rail for movement parallel to and fastened to the guide element.

8. The device as in claim 1, wherein the four-part articulation include a pivoting component and further comprising locking means having a pivotable engaging element and a locking element mounted on the pivoting component for movement into a locking position in response to transverse motion of the guide element wherein the locking element engages the engaging element to lock the at least one panel in a desire position.

9. The device as in claim 8, further comprising means coupled to the drive means for pivoting the engaging element to disengage the locking element.

10. The device as in claim 9, wherein the means for pivoting the engaging element comprises a control element for pivoting the engaging element before the at least one panel begins to move.

* * * * *